US005374938A

United States Patent [19]

Hatazawa et al.

[11] Patent Number: 5,374,938

[45] Date of Patent: Dec. 20, 1994

[54] WAVEGUIDE TO MICROSTRIP CONVERSION MEANS IN A SATELLITE BROADCASTING ADAPTOR

[75] Inventors: Kenji Hatazawa, Minamikawachi; Hiroyuki Mukai, Yao; Junichi Somei, Yamatokoriyama, all of Japan

[73] Assignee: Sharp Kabushiki Kaisha, Osaka, Japan

[21] Appl. No.: 6,833

[22] Filed: Jan. 21, 1993

[30] Foreign Application Priority Data

Jan. 21, 1992 [JP] Japan ..... 4-008299
Jul. 2, 1992 [JP] Japan ..... 4-175258

[51] Int. Cl.[5] ..... H01P 1/161; H01P 5/107; H01Q 13/06; H01Q 15/24

[52] U.S. Cl. ..... 343/756; 343/786; 333/21 A; 333/26; 333/125

[58] Field of Search ..... 333/26, 21 R, 21 A, 333/137, 125; 343/756, 786

[56] References Cited

U.S. PATENT DOCUMENTS

| | | | |
|---|---|---|---|
| 2,640,877 | 6/1953 | Miller et al. | 333/249 |
| 4,258,366 | 3/1981 | Green | 343/786 |
| 4,596,047 | 6/1986 | Watanabe et al. | 333/26 X |
| 4,626,865 | 12/1986 | Rammos | 343/786 |
| 4,737,741 | 4/1988 | Wong | 333/137 X |
| 4,853,657 | 8/1989 | Cruchon et al. | 333/137 |
| 5,005,023 | 4/1991 | Harris | 343/756 |
| 5,162,808 | 11/1992 | Kim | 343/786 |

FOREIGN PATENT DOCUMENTS

| | | | |
|---|---|---|---|
| 3111106 | 3/1981 | Germany . | |
| 2223201 | 9/1990 | Japan . | |
| 4134901 | 5/1992 | Japan | 333/21 A |
| 675118 | 11/1949 | United Kingdom . | |

OTHER PUBLICATIONS

Integrated Input Circuit For Satellite Converter, Modelski et al., Sep. 1989, pp. 543–548.

Polarized Multiplexer, Patent Abstracts of Japan, vol. 10, No. 283, Sep. 1986.

Strip Line–Waveguide Converter, Patent Abstracts of Japan, vol. 11, No. 46, Feb. 1987.

"Microwave Circuit" published by Omu Sha on Mar. 10, 1984. pp. 194–208 and p. 330.

*Primary Examiner*—Benny T. Lee

[57] ABSTRACT

A waveguide to microstrip converter allowing size reduction as well as providing good cross polar discrimination and input VSWR characteristic. The waveguide to microstrip converter includes a structure of an orthogonal transducer formed of a circular waveguide and a rectangular waveguide integrally formed with and orthogonal to the circular waveguide. A first probe and a second probe are respectively coupled to the circular waveguide and rectangular waveguide. An output terminal of the first probe and an output terminal of the second probe are formed on the same plane and connected to respective microstrip lines.

19 Claims, 18 Drawing Sheets

WAVEGUIDE TO MICROSTRIP CONVERSION MEANS IN A SATELLITE BROADCASTING ADAPTOR

BACKGROUND OF THE INVENTION

1. Field of the Invention

The present invention relates generally to waveguide to microstrip conversion means and more specifically, to a waveguide to microstrip conversion means in a satellite broadcasting antenna for receiving first and second linearly polarized waves orthogonal to each other.

2. Description of the Background Art

Conventional outdoor converters for receiving satellite broadcasting have been known which are installed on outdoor antennas for receiving two kinds of independent linearly polarized waves (horizontally polarized wave and vertically polarized wave) orthogonal to each other.

FIG. 20 is a partial perspective view showing the internal structure of a conventional waveguide to microstrip converter used for a conventional outdoor converter for receiving satellite broadcasting. Referring to FIG. 20, the converter includes a circular waveguide 101, a first microstrip circuit substrate 102 attached at a prescribed position in the outer periphery of the circular waveguide, a first probe 105 attached on first microstrip circuit substrate 102 and formed protruding as far as the interior of circular waveguide 101 through its opening, a short circuit element (shorting rod) 104 provided inside circular waveguide 101, being ¼ wavelength spaced apart and downwardly from the position where first probe 105 is attached, a second probe 106 formed protruding into circular waveguide 101 and about a half wavelength spaced apart downwardly from first probe 105, a second microstrip circuit substrate 103 provided with second probe 106 through the opening of circular waveguide 101 and attached to the outer periphery of circular waveguide 101, and a short circuit element (shorting plate) 107 attached a ¼ wavelength apart downwardly from second probe 106.

First probe 105 and short circuit element 104 are disposed so that their extending directions are approximately the same. First probe 105 and second probe 106 are disposed so that their extending directions are orthogonal to each other. First probe 105 is for detecting a horizontally polarized wave 1, and second probe 106 is for detecting a vertically polarized wave 2. Short circuit terminal (shorting rod) 104 reflects the horizontally polarized wave 1 and allows its detection by first probe 105, and short circuit terminal (shorting plate) 107 reflects the vertically polarized wave 2 and allow its detection by second probe 106.

Two probes are generally necessary for a single waveguide to receive two kinds of linearly polarized waves orthogonal to each other. Each of the probes receives a signal having a plane of polarization parallel to them. In order to prevent interference of signals having a plane of polarization other than the plane parallel to the probe and improve cross polar discrimination, as shown in FIG. 20, it will be necessary to dispose the first probe 105 and second probe 106 of circular waveguide 101 so as to be orthogonal to each other and coaxially spaced apart from each other. In order to improve the input VSWR (Voltage Standing Wave Ratio) of the waveguide and to prevent conversion losses at first probe 105 and second probe 106 within a broad band width, first probe 105 and shorting rod 104 as well as second probe 106 and shorting plate 107 should be both spaced apart from each other by ¼ wavelength.

FIG. 21 is a perspective view showing the internal structure of an alternative type of a conventional waveguide to microstrip converter. Referring to FIG. 21, the converter includes a circular waveguide 201, a microstrip circuit substrate 202 attached at a predetermined position in the outer periphery of circular waveguide 201, a first probe 203 attached on microstrip circuit substrate 202 and protruding into circular waveguide 201, a second probe 204 attached to microstrip circuit substrate 202 and protruding into circular waveguide 201 in the direction orthogonal to first probe 203 on the same plane, and a short circuit terminal (shorting plate) 205 disposed ¼ wavelength spaced apart downwardly from first probe 203 and second probe 204. In this conventional waveguide to microstrip converter, the first probe 203 and second probe 204 are positioned on the same plane. Thus providing first probe 203 and second probe 204 on the same plane reduces the size of the apparatus.

As in the foregoing, in the structure of the conventional waveguide to microstrip converter shown in FIG. 20, first probe 105 and second probe 106 are spaced about half wavelength apart from each other, in order to prevent interference of a signal received by first probe 105 and a signal received by second probe 106 thereby improving cross polar discrimination.

However in such a structure, with first probe 105 not being coplanar with second probe 106, it is not possible to directly connect both first probe 105 and second probe 106 to a single microstrip circuit substrate. As shown in FIG. 20, two microstrip circuit substrates, first microstrip circuit substrate 102 and second microstrip circuit substrate 103 are necessary as a result. This increases the number of parts and complicates the manufacturing process, thus impeding cost reduction and productivity improvements. Additionally, with the separation distance between first probe 105 and second probe 106 being substantial, circular waveguide 101 results in a relatively long structure. This makes it difficult to reduce the size and weight of the apparatus.

In the case of the other conventional waveguide to microstrip converter shown in FIG. 21, as in the foregoing, the provision of first probe 203 and second probe 204 on the same plane allows for reduction of the size of the apparatus. In the structure shown in FIG. 21, however, as first probe 203 and second probe 204 are on the same plane, they both suffer from the interference of signals having a plane of polarization other than the planes of polarization they are supposed to receive. Consequently, the apparatus suffers from the disadvantage that the cross polar discrimination is degraded.

As described above, conventionally the structure of the apparatus should be expanded at the sacrifice of size reduction in order to provide good cross polar discrimination and input VSWR. If first probe 203 and second probe 204 are formed on the same plane for reducing the size of the apparatus, cross polar discrimination deteriorates.

SUMMARY OF THE INVENTION

It is therefore an object of the present invention to achieve size reduction and provide improved cross polar discrimination by effectively preventing two probes from adversely affecting each other, in a waveguide to microstrip converter.

Another object of the present invention is to form the output terminals of the respective probes of two converters on the same plane, in a waveguide to microstrip converter.

A still further object of the present invention is to achieve cost reduction and productivity improvements in a waveguide to microstrip converter.

A waveguide to microstrip converter having a microstrip circuit according to the invention for receiving first and second linearly polarized waves orthogonal to each other in one aspect includes a first waveguide, a second waveguide coupled substantially orthogonally to the first waveguide, a first probe coupled to the first waveguide for detecting the first linearly polarized wave, a second probe coupled to the second waveguide for detecting a second linearly polarized wave, and matching means for guiding the second linearly polarized wave into the second waveguide.

In operation, since the second waveguide is coupled substantially orthogonally to the first waveguide, the first probe for detecting the first linearly polarized wave is coupled to the first waveguide, the second probe for detecting the second linearly polarized wave is coupled to the second waveguide, and a matching means for guiding the second linearly polarized wave into the second waveguide is provided therebetween, a sufficiently large distance is provided between the first probe and second probe without increasing the size of the device.

In another aspect of the invention, a converter for antenna for satellite broadcasting including a waveguide to microstrip converter includes a first waveguide, a second waveguide coupled substantially orthogonally to the first waveguide, a first probe coupled to the first waveguide for detecting a first linearly polarized wave, a second probe coupled to the second waveguide for detecting a second linearly polarized wave, matching means for guiding the second linearly polarized wave into the second waveguide, and a horn for guiding the first and second linearly polarized waves into the first waveguide.

In operation, since the waveguide to microstrip converter is formed of the first waveguide, the second waveguide coupled substantially orthogonally to the first waveguide, the first probe coupled to the first waveguide for detecting the first linearly polarized wave, the second probe coupled to the second waveguide for detecting the second linearly polarized wave, and matching means for guiding the second linearly polarized wave into the second waveguide, with the horn for guiding the first and second linearly polarized waves into the first waveguide being provided at the end of the first waveguide not coupled to the second waveguide, a sufficiently large separation is provided between the first and second probes without increasing the size of the waveguide to microstrip converter, and, therefore, the size of the converter for antenna for satellite broadcasting including such waveguide to coaxial adaptor can be reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A description of the preferred embodiments of the present invention follows in conjunction with the drawings.

Figure 1:
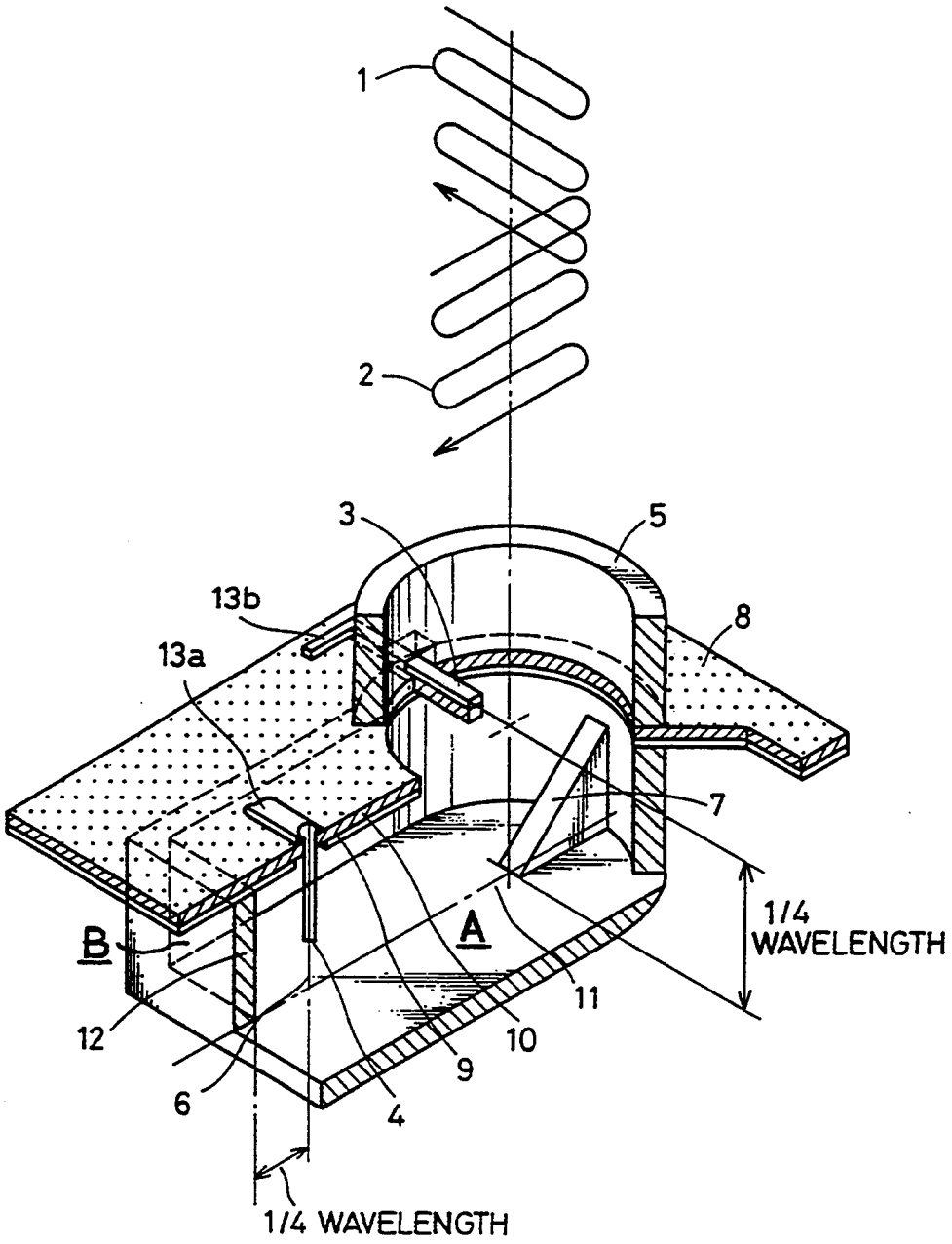
FIG. 1 is a perspective view showing the internal structure of a waveguide to microstrip converter in accordance with a first embodiment of the present invention.

Referring to FIG. 1, a waveguide to microstrip converter in accordance with a first embodiment includes a circular waveguide 5 coupled to a primary feed horn (not shown), a rectangular waveguide 6 connected integrally with and extending approximately orthogonally to circular waveguide 5, a circuit board 10 formed of Teflon being attached and held by circular waveguide 5 at a prescribed position thereof, a microstrip circuit substrate 8 formed on the surface of board 10, an earth surface (ground plane) 9 formed on the bottom surface of board 10 and constituting the top surface of rectangular waveguide 6, a first probe 3 formed of board 10, microstrip circuit substrate 8 and a microstrip line 13*b* and protruding inside circular waveguide 5, a second probe 4 connected to microstrip line 13*a* and protruding into rectangular waveguide 6, a reflection rib for matching 7 formed at the corner of the juncture of circular waveguide 5 and rectangular waveguide 6, a short circuit terminal A implemented by surface 11, and a short circuit terminal B, implemented by surface 12.

First probe 3 is for detecting a horizontally polarized wave 1, and the second probe 4 is for detecting a vertically polarized wave 2. Short circuit terminal A, i.e. surface 11, reflects the horizontally polarized wave 1 and allows the first probe 3 to detect the reflected wave. First probe 3 and short circuit terminal A (surface 11) are disposed $\frac{1}{4}$ wavelength away from each other. A wedge shaped impedance matching reflection rib is for reflecting only the vertically polarized wave 2 by 90° in the direction of second probe 4. Short circuit terminal B, i.e. surface 12, further reflects the vertically polarized wave 2 reflected from reflection rib for matching 7 and allows second probe 4 to detect the reflected wave. Second probe 4 and short circuit B (surface 12) are apart from each other by a spacing of $\frac{1}{4}$ wavelength.

A brief description of the operation of the waveguide to microstrip converter in accordance with the present embodiment will now follow.

Two kinds of linearly polarized waves (horizontally polarized wave 1, vertically polarized wave 2) orthogonal to each other and introduced by the primary feed horn (not shown) is transmitted into circular waveguide 5. The horizontally polarized wave 1 parallel to first probe 3 is reflected by short circuit terminal A (surface 11) which is $\frac{1}{4}$ wavelength away from first probe 3, and the horizontally polarized wave 1 which is not reflected and the reflected horizontally polarized wave 1 are matched. The matched horizontally polarized wave 1 is detected by first probe 3 and transmitted to microstrip line 13*b*.

Vertically polarized wave 2 propagates in circular waveguide 5 substantially free from the effect of first probe 3. The mismatching and loss in passage of the vertically polarized wave 2 are reduced by reflection rib for matching 7 which has substantially no effect on the horizontally polarized wave 1. In this state, the vertically polarized wave 2 is turned by 90° for transmission into rectangular waveguide 6. The vertically polarized wave 2 is reflected by short circuit terminal B, (surface 12) and the non-reflected vertically polarized wave 2 and the reflected vertically polarized wave 2 are matched. The matched horizontally polarized wave 2 is detected by second probe 4 and transmitted to microstrip line 13*a*.

As in the foregoing, according to the present embodiment, a structure of an orthogonal transducer in which circular waveguide 5 and rectangular waveguide 6 orthogonal thereto are integrally formed is employed, with first probe 3 and second probe 4 being provided to circular waveguide 5 and rectangular waveguide 6, respectively. Such a structure makes it possible to widen the space between first probe 3 and second probe 4 without increasing the size of the apparatus as is conventionally practiced, and, therefore, good cross polar discriminations can be provided while achieving size reduction of the apparatus.

Figure 20:
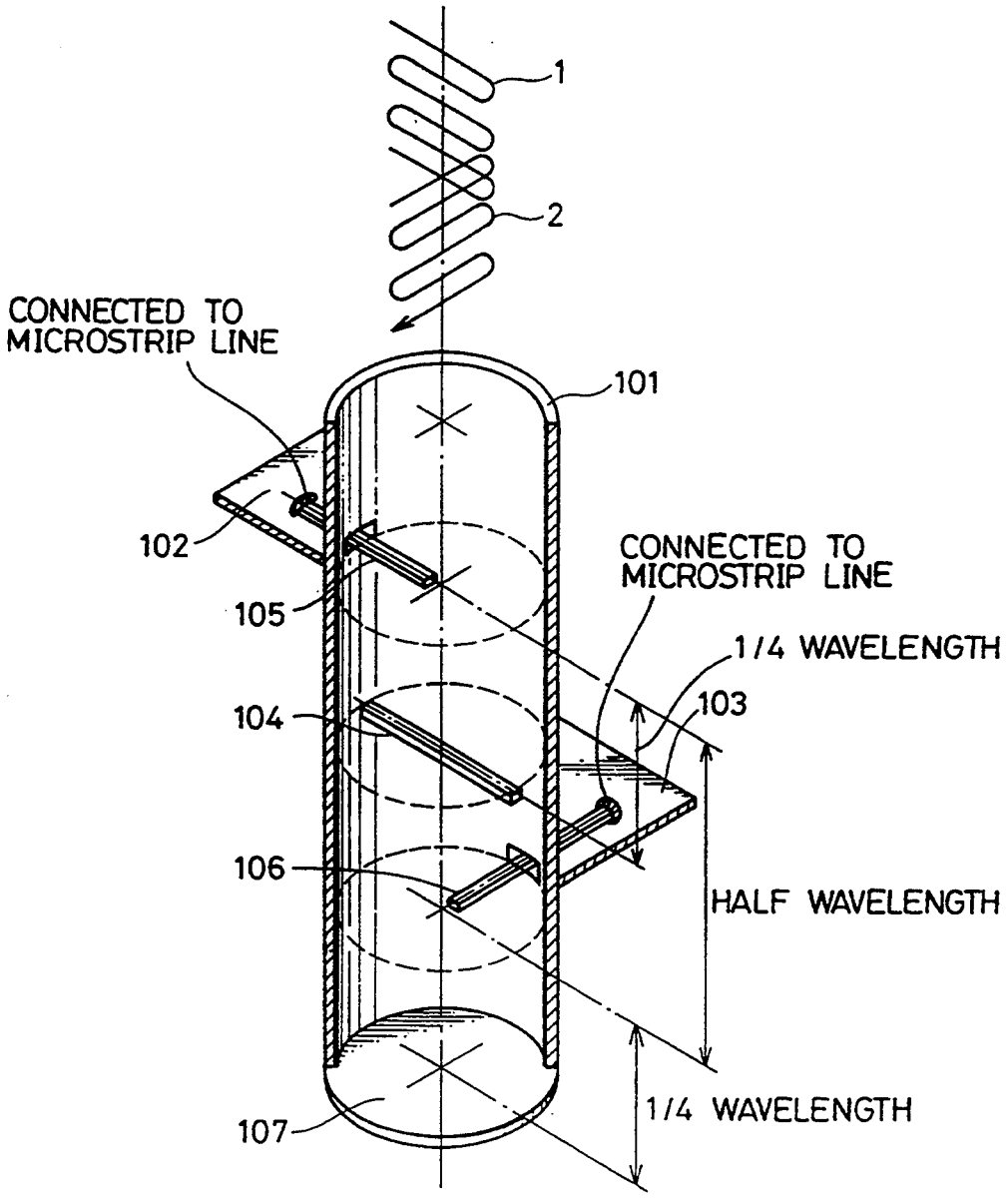
FIG. 20 PRIOR ART
FIG. 20 is a perspective view showing the internal structure of a conventional waveguide to microstrip converter.

Also in the present embodiment, the provision of the output terminals of first probe 3 and second probe 4 on the same plane enables implementation of a structure requiring only microstrip circuit substrate 8. More specifically, connecting microstrip lines 13*a* and 13*b* formed on microstrip circuit substrate 8 to second probe 4 and first probe 3, respectively allows implementation of the apparatus only with microstrip circuit substrate 8, unlike the conventional waveguide to microstrip converter shown in FIG. 20. Consequently, the number of parts and the costs of the apparatus can be reduced.

Furthermore, the shapes of the parts can be simplified as well as materials for the parts can be reduced through the forming of the top surface of rectangular waveguide 6 by ground plane surface 9 which constitutes the bottom surface of circuit board 10 of microstrip circuit substrate 8. Thus, the productivity can be improved and the cost can be reduced.

Figure 2:
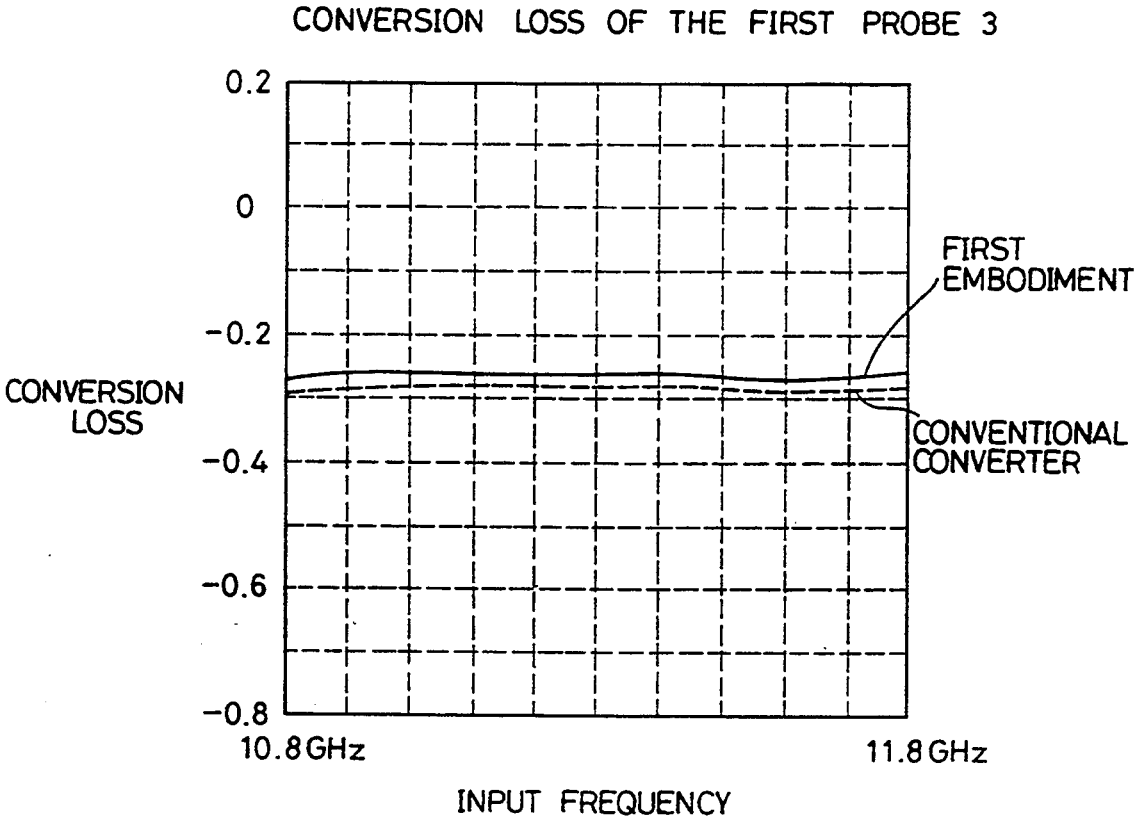
FIG. 2 is a graphic representation showing a comparison of the conversion loss characteristics of first probes in a conventional waveguide to microstrip converter shown in FIG. 21 and the waveguide to microstrip converter in the first embodiment shown in FIG. 1.
Figure 3:
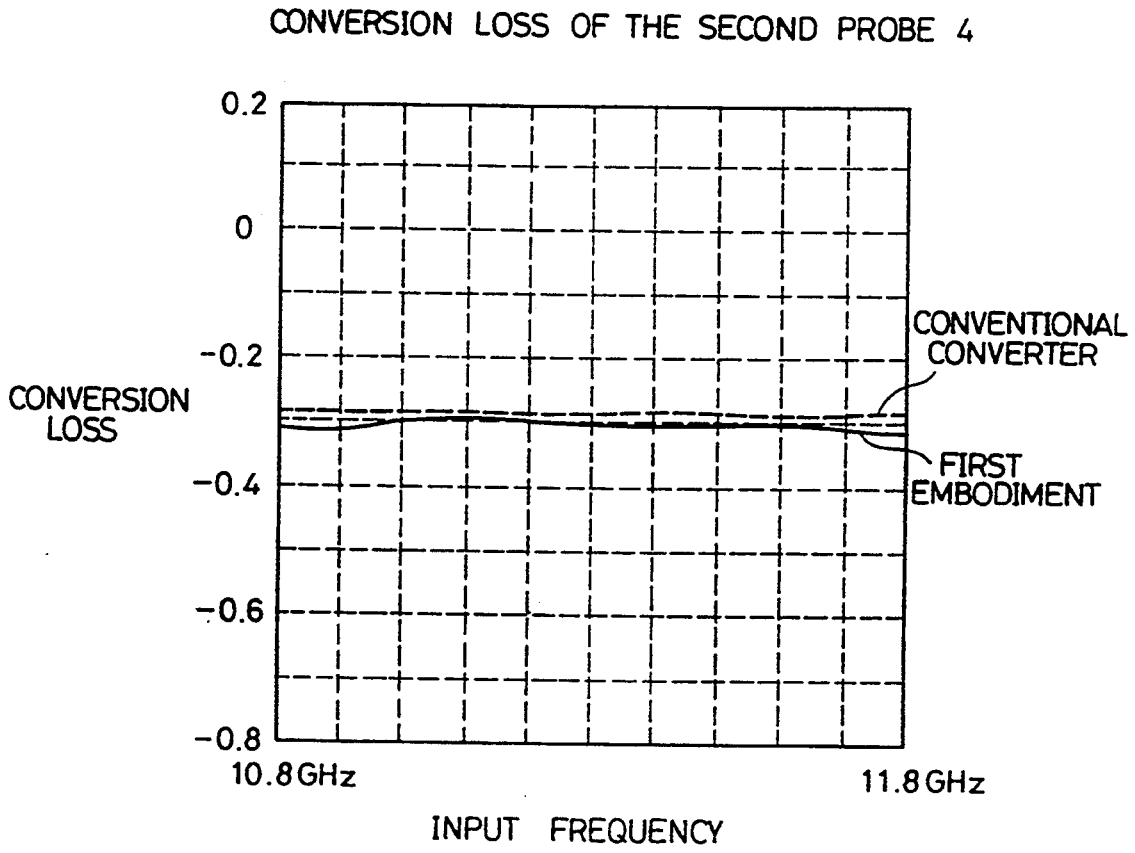
FIG. 3 is a graphic representation showing a comparison of the conversion loss characteristics of second probes in the conventional waveguide to microstrip converter shown in FIG. 21 and the waveguide to microstrip converter in the first embodiment shown in FIG. 1.
Figure 4:
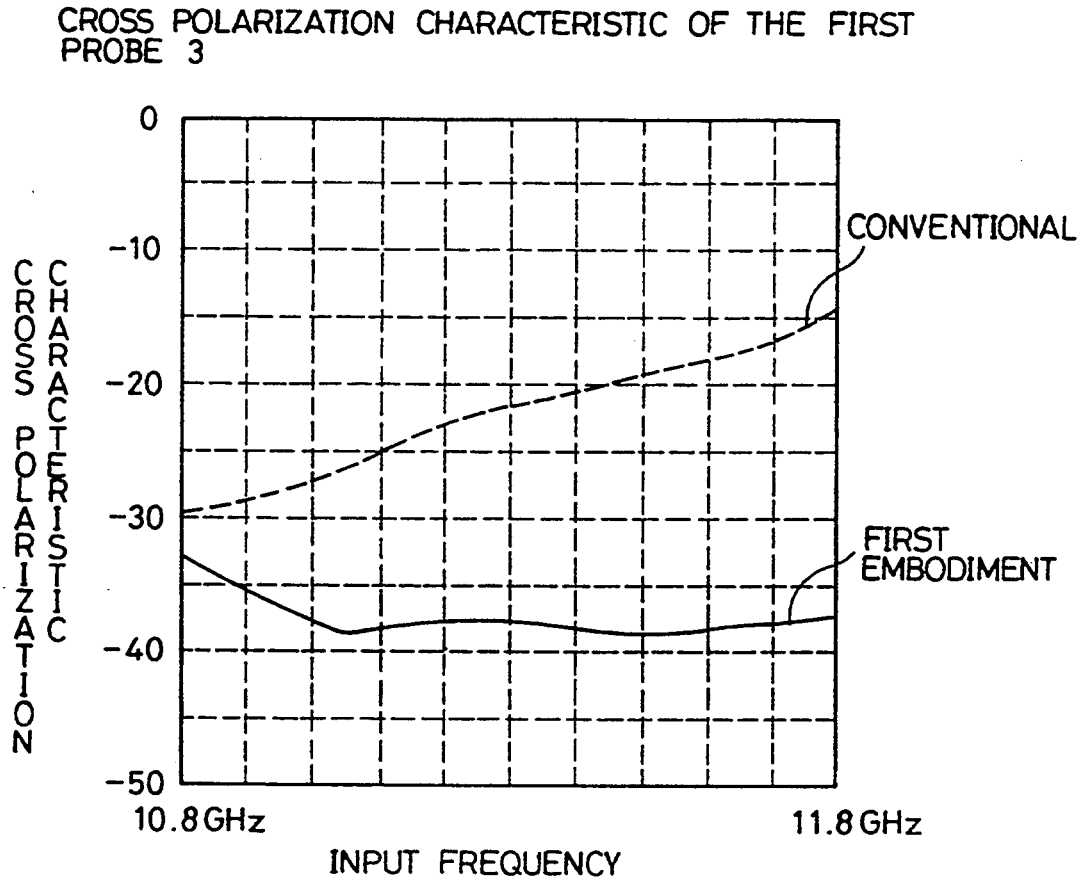
FIG. 4 is a graphic representation showing a comparison of the cross polar discriminations of the first probes in the conventional waveguide to microstrip converter shown in FIG. 21 and the waveguide to microstrip converter in the first embodiments shown in FIG. 1.
Figure 5:
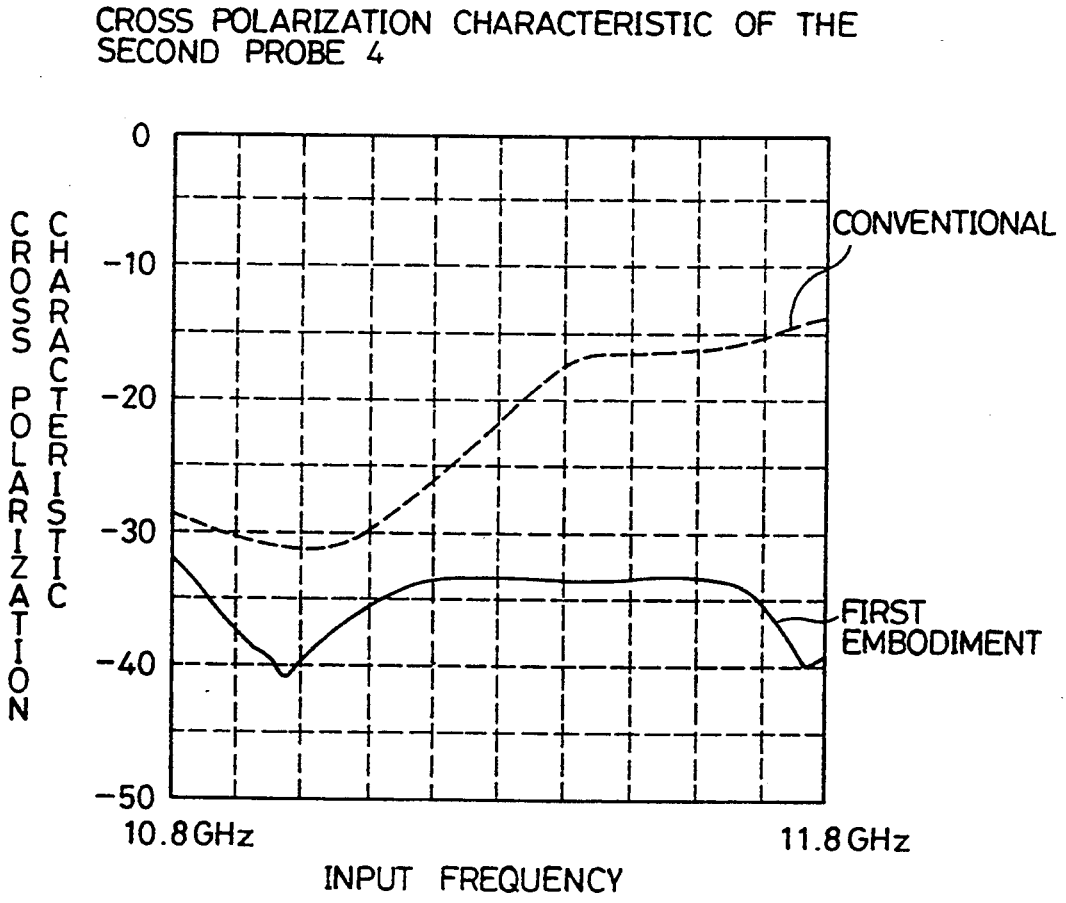
FIG. 5 is a graphic representation showing a comparison of the cross polar discriminations of the second probes in the conventional waveguide to microstrip converter shown in FIG. 21 and the waveguide to microstrip converter in the first embodiment shown in FIG. 1.
Figure 21:
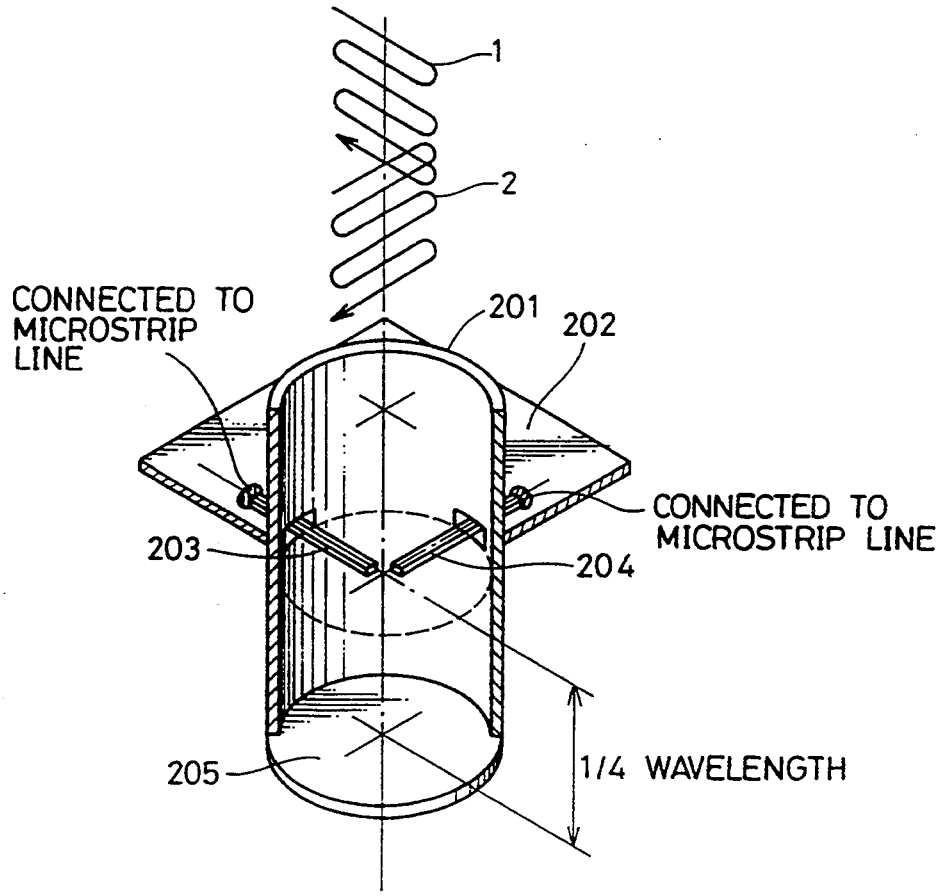
FIG. 21 PRIOR ART
FIG. 21 is a perspective view showing the internal structure of another conventional waveguide to microstrip converter.

As can be seen from FIGS. 2 through 5, there is little difference between the conventional waveguide to microstrip converter shown in FIG. 21 and the waveguide to microstrip converter of the first embodiment in conversion loss characteristics as shown in FIGS. 2 and 3. In contrast, as seen in FIGS. 4 and 5, it is noted that as for their cross polar discriminations, the waveguide to coaxial adaptor of the first embodiment shown in FIG. 1 is superior to the conventional waveguide to microstrip converter shown in FIG. 21. As in the foregoing, in the waveguide to microstrip converter of the first embodiment shown in FIG. 1, both size reduction and improvements of performance such as cross polar discrimination can be achieved.

Figure 6:
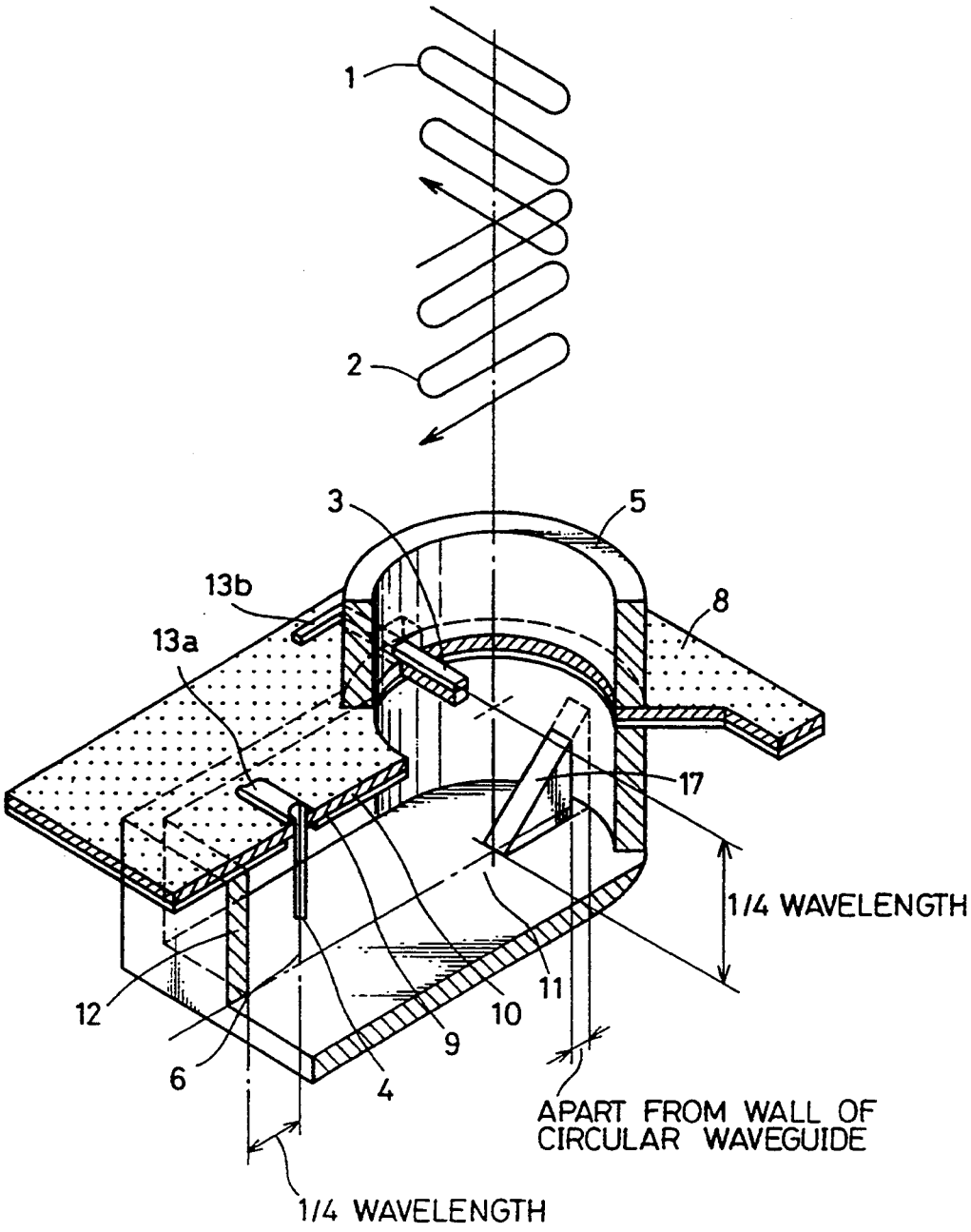
FIG. 6 is a perspective view showing the internal structure of a waveguide to microstrip converter in accordance with a second embodiment of the present invention.

Referring to FIG. 6, according to a second embodiment, which is like FIG. 1 and includes all the elements thereof, however, the end surface of a reflection rib for matching 17 on the side of circular waveguide 5 is disposed at a position a predetermined distance away from the internal wall of circular waveguide 5. Such a structure provides an input VSWR characteristic and a cross polar discrimination similar to the cross waveguide converter of the first embodiment shown in FIG. 1. The performance of the first embodiment shown in FIG. 1 is sometimes superior to the performance of the second embodiment shown in FIG. 6 and vice versa depending upon input frequencies. In this case, a waveguide to coaxial adaptor having a superior performance can be provided depending upon a frequency bandwidth desired.

Figure 7:
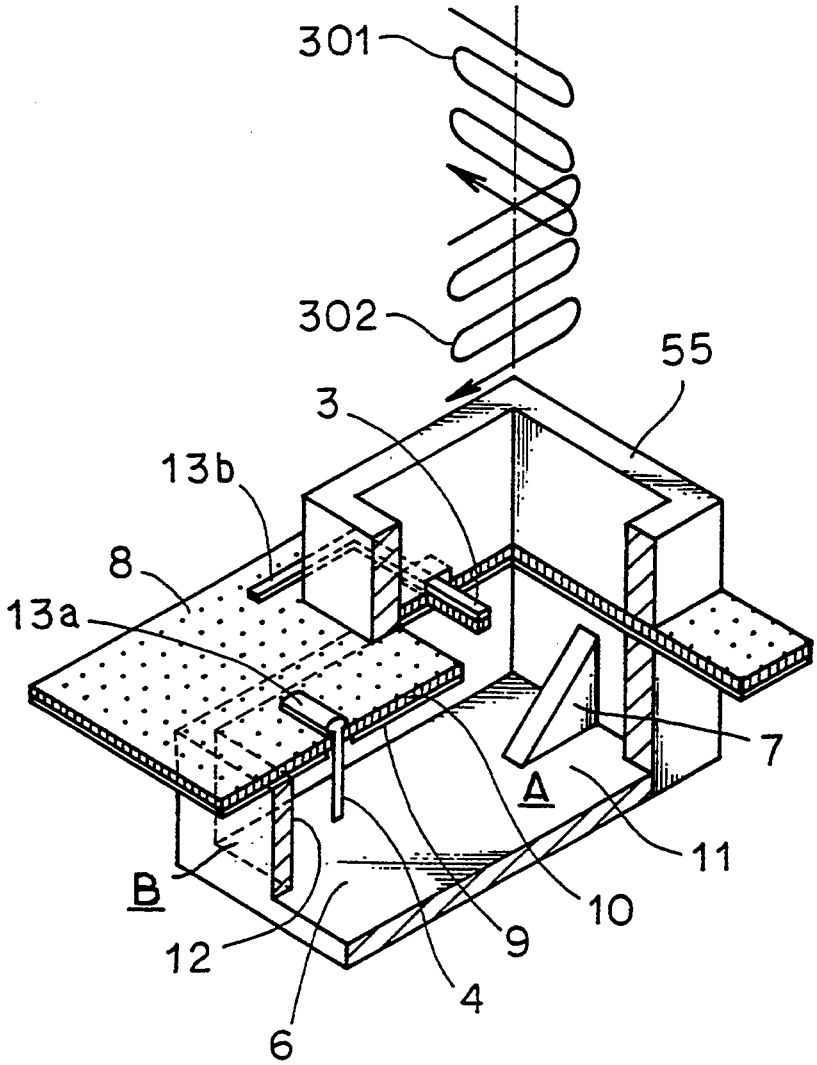
FIG. 7 is a perspective view showing the internal structure of a waveguide to microstrip converter in accordance with a third embodiment of the invention.

FIG. 7 is a perspective view showing the internal structure of a waveguide to microstrip converter in accordance with a third embodiment of the invention. Referring to FIG. 7, the waveguide to microstrip converter in accordance with the third embodiment includes a rectangular waveguide (square waveguide) 55 coupled to a feed horn (horn) which is not shown, a rectangular waveguide (square waveguide) 6 integrally coupled to rectangular waveguide 55 and formed in a direction substantially orthogonal to the direction in which the rectangular waveguide 55 extends, a circuit board 10 of Teflon attached at a prescribed position of rectangular waveguide 55 and held by rectangular waveguide 55, a microstrip circuit substrate 8 formed on the top surface of board 10, an earth surface (ground plane) 9 formed on the bottom surface of board 10 and forming the top surface of rectangular waveguide 6, a first probe 3 formed of board 10, microstrip circuit substrate 8, and the microstrip line 13b and protruding inside rectangular waveguide 55, a second probe 4 connected to microstrip line 13*a* and formed protruding inside rectangular waveguide 6, a triangular shaped matching reflector rib 7 formed at a corner portion of the coupling portion of rectangular waveguide 55 and rectangular waveguide 6, a short circuit terminal A surface 11, and a short circuit terminal B (surface 12). First probe 3 is for receiving a first linearly polarized wave 301, while second probe 4 is for receiving a second linearly polarized wave 302. Rectangular waveguide 55 takes a square or substantially square shape so as to pass the first and second linearly polarized waves 301 and 302. Matching reflector rib 7 is for impedance-matching rectangular waveguide 55 and rectangular waveguide 6 thereby reflecting the second linearly polarized wave 302 by 90° toward second probe 4. Short circuit terminal A, (surface 11), has a function of reflecting the first linearly polarized wave 301 and guiding the reflected wave to first probe 3. Meanwhile, the short circuit terminal B, (surface 12), has a function of reflecting the second linearly polarized wave 302 and guiding the reflected wave to second probe 4.

As described above, according to the third embodiment, as opposed to the first and second embodiments, rectangular waveguide 55 is also employed for the waveguide on the input side. Such a structure can provide the same effect as the waveguides to coaxial adapter in accordance with the first and second embodiments. More specifically, since rectangular waveguide 55 and rectangular waveguide 6 orthogonal thereto constitute a form of an orthogonal transducer, a sufficient distance between first probe 3 and second probe 4 can be secured while reducing the size of the device. Thus, first probe 3 and second probe 4 do not affect each other, and good cross polar discrimination and input VSWR characteristics can be provided.

Figure 8:
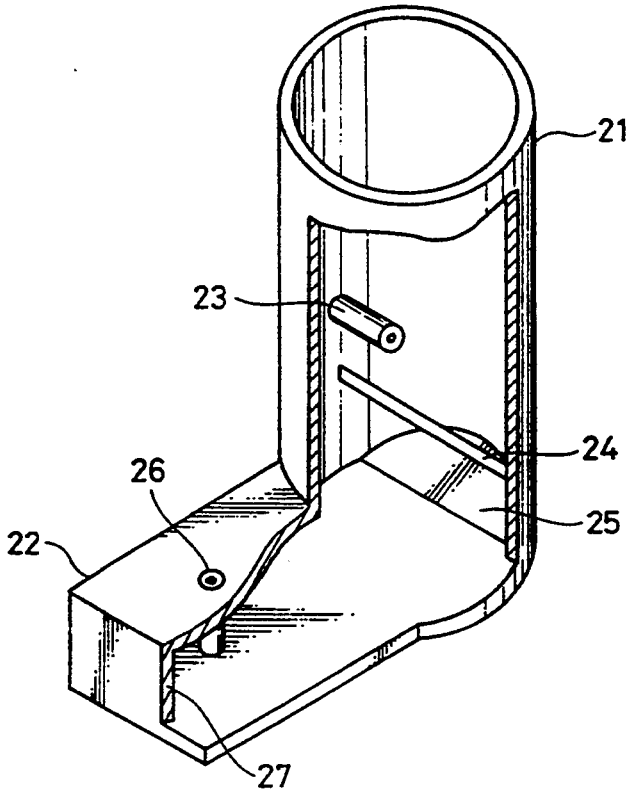
FIG. 8 is a perspective view showing the internal structure of a waveguide to microstrip converter in accordance with a fourth embodiment of the present invention.

Referring to FIG. 8, the waveguide to microstrip converter of a fourth embodiment includes a circular waveguide 21, a rectangular waveguide 22 connected integrally with circular waveguide 21 and extending in the direction orthogonal to the direction in which circular waveguide 21 extends, a first probe 23 disposed protruding in a prescribed direction in the hollow part of circular waveguide 21, a second probe 26 disposed protruding in a prescribed direction in the hollow part of the rectangular waveguide, a reflection surface for matching 25 provided at the juncture of circular waveguide 21 and rectangular waveguide 22, a shorting element (short rod) 24 disposed between first probe 23 and reflection surface for matching 25 and in the same direction as first probe 23, and a short circuit plate 27 disposed at an end of rectangular waveguide 22 and a prescribed space apart from second probe 26. First probe 23 and short circuit rod 24 are attached ¼ wavelength apart from each other. Short circuit surface 27 and second probe 26 have a spacing of ¼ wavelength from each other.

In the waveguide to microstrip converter according to the fourth embodiment, similar effects to the waveguides to coaxial adaptors of the first, second and third embodiments can be provided. More specifically, by forming a structure of an orthogonal transducer using circular waveguide 21 and rectangular waveguide 22 orthogonal thereto, first probe 23 and second probe 26 can be spaced apart from each other while achieving size reduction of the apparatus. Thus, first probe 23 and second probe 26 do not affect each other, thus providing good cross polar discrimination and input VSWR characteristic. In the fourth embodiment, unlike the first, second and third embodiments, the rod shaped short circuit element 24 is used for the reflector of first probe 23.

In operation, as is the case with the first, second and third embodiments, the horizontally polarized wave (not shown) is received using short circuit rod 24 and first probe 23, and the vertically polarized wave (not shown) is received using reflection surface for matching 25, short circuit plate 27 and second probe 26.

Figure 9:
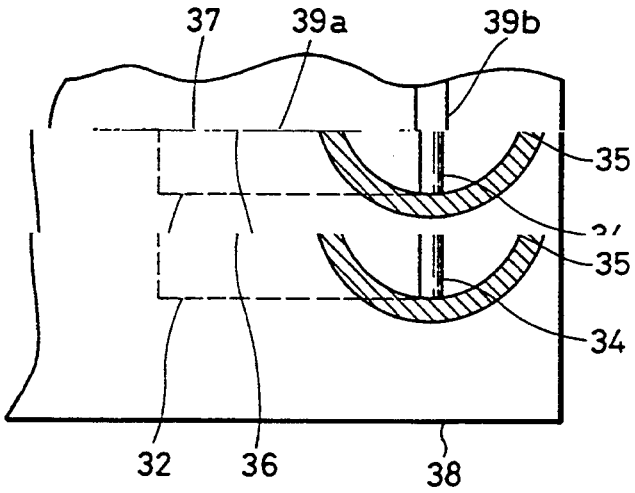
FIG. 9 is a top plan view showing a waveguide to microstrip converter in accordance with a fifth embodiment of the present invention.
Figure 10:
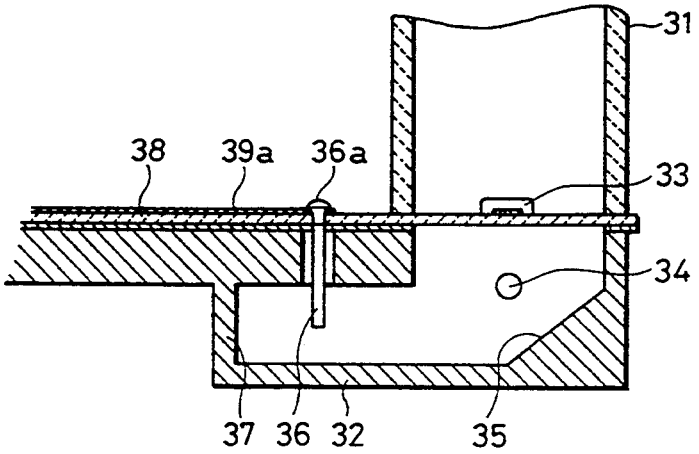
FIG. 10 is a sectional view showing the waveguide to microstrip converter in the fifth embodiment taken along line X—X in FIG. 9.

A waveguide to microstrip converter in accordance with a fifth embodiment shown in FIGS. 9 and 10 is an application of the waveguide to microstrip converter of the fourth embodiment shown in FIG. 8.

Referring to FIGS. 9 and 10, the waveguide to microstrip converter of the present embodiment includes a circular waveguide 31, a rectangular waveguide 32 connected integrally with and extending orthogonally to circular waveguide 31, a microstrip circuit substrate 38 attached and held between circular waveguide 31 and rectangular waveguides 32, microstrip lines 39*a* and 39*b* formed on microstrip circuit substrate 38, a first probe 33 formed of microstrip line 39*b* (see FIG. 9) extending into the hollow part of circular waveguide 31, a second probe 38 connected to microstrip line 39*a* and protruding into the hollow part of rectangular waveguide 32, a reflection surface for matching 35 formed at the position where circular waveguide 31 and rectangular waveguide 32 intersect each other, a short circuit plate 37 formed at an end surface of rectangular waveguide 32 and ¼ wavelength spaced apart from second probe 36, a shorting circuit rod 34 formed between first probe 33 and reflection surface for matching 35 and ¼ wavelength apart from and in the same direction as first probe 33.

As in the foregoing, according to the fifth embodiment, the provision of the output terminal 36*a* (see FIG. 10) of second probe 36 and first probe 33 on the same plane allows the implementation of the apparatus only with one microstrip circuit substrate 38. More specifically, first probe 33 and the output terminal 36*a* of second probe 36 being on the same plane can be connected to microstrip lines 39*b* and 39*a*, respectively formed on the same microstrip circuit substrate 38. Consequently, the waveguide to microstrip converter of the present embodiment can be implemented by only a single microstrip circuit substrate 38. This reduces the number of parts compared to conventional apparatuses, resulting in productivity improvements as well as cost reduction of the apparatus.

Figure 11:
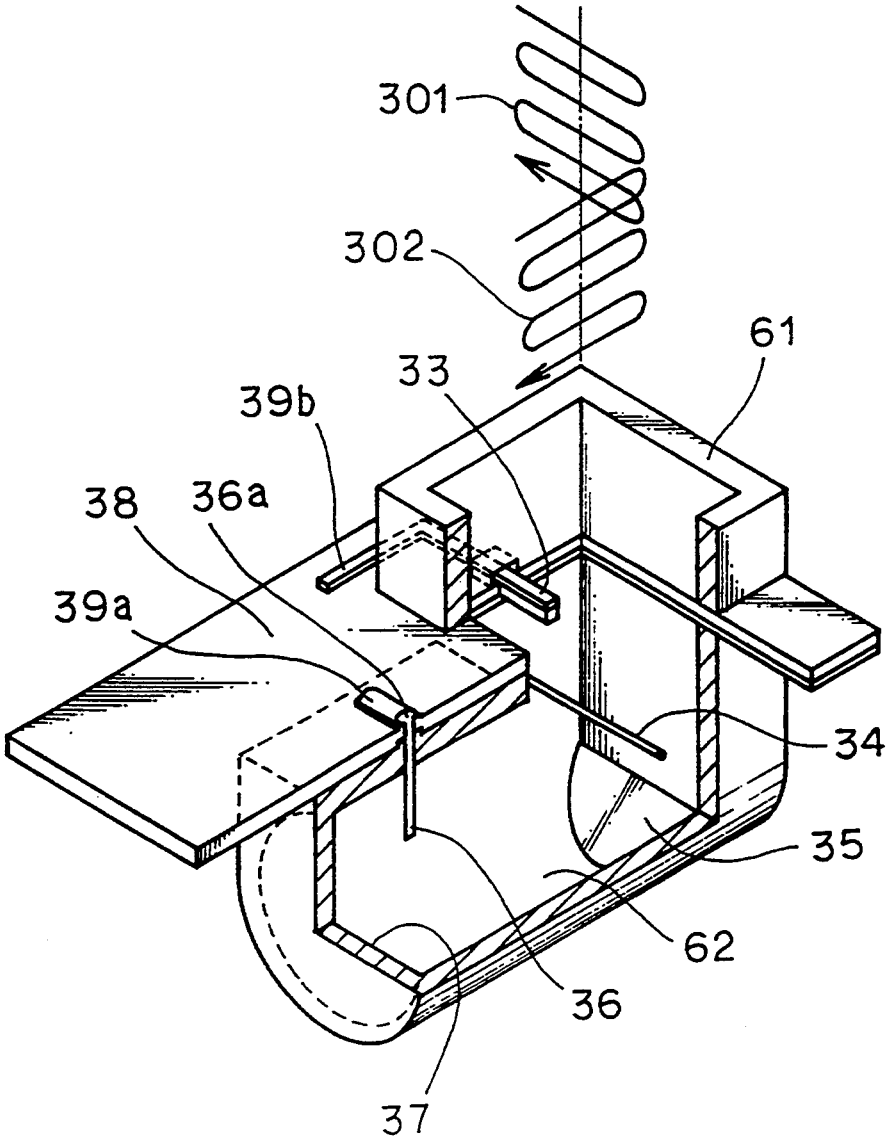
FIG. 11 is a perspective view showing the internal structure of a waveguide to microstrip converter in accordance with a sixth embodiment of the invention.

FIG. 11 is a perspective view showing internal structure of a waveguide to microstrip converter in accordance with a sixth embodiment of the invention. Referring to FIG. 11, the waveguide to microstrip converter in accordance with the sixth embodiment includes a rectangular waveguide (square waveguide) 61 on the input side, a circular waveguide 62 integrally coupled to rectangular waveguide 61 and formed extending in a direction substantially orthogonal to rectangular waveguide 61, a microstrip circuit substrate 38 attached between rectangular waveguide 61 and circular waveguide 62, microstrip line 39*a* and 39*b* formed on microstrip circuit substrate 38, a first probe 33 formed by the extension of microstrip line 39*b* into the hollow part of rectangular waveguide 61, a second probe 36 connected to microstrip line 39*a* and formed protruding into the hollow part of circular waveguide 62, a matching reflector surface 35 formed at a position at which rectangular waveguide 61 intersects circular waveguide 62, a short circuit element comprising the wall 37 formed at an end surface of circular waveguide 62 and ¼ wavelength apart from second probe 36, a shorting circuit rod 34 formed between first probe 33 and matching reflector surface 35 and ¼ wavelength apart from and in the same direction as first probe 33. Rectangular waveguide 61 takes a square or substantially square shape so as to pass the first linearly polarized wave 301 and the second linearly polarized wave 302 intersecting the first linearly polarized wave 301.

Circular waveguide 62 has a function of passing the second linearly polarized wave 302. First probe 33 is for receiving the first linearly polarized wave 301, while second probe 36 is for receiving the second linearly polarized wave 302. Shorting circuit rod 34 has a function of reflecting the first linearly polarized wave 302 and guiding the reflected wave to first probe 33. Shorting circuit wall 37 has a function of reflecting the second linearly polarized wave 302 and guiding the reflected wave to second probe 36. Matching reflector surface 35 is for impedance-matching rectangular waveguide 61 and circular waveguide 62 and reflecting the second linearly polarized wave 302 by 90° toward second probe 36.

As described above, in accordance with the second embodiment, as opposed to the fifth embodiment shown in FIGS. 9 and 10, rectangular waveguide 61 is employed as a waveguide on the input side, and circular waveguide 62 is employed as a waveguide orthogonal to rectangular waveguide 61. In the sixth embodiment, as with the fifth embodiment, forming the output end 36*a* of second probe 36 and first probe 33 in one plane allows arrangement by only one microstrip circuit substrate 38. More specifically, with first probe 33 and the output end 36*a* of the second probe 36 being in one plane, they can be connected to microstrip line 39*b* and 39*a*, respectively formed on the same microstrip circuit substrate 38. Thus, the waveguide to microstrip converter in accordance with the sixth embodiment can be structured only by single microstrip circuit substrate 38. Consequently, the number of parts necessary will be reduced as compared to conventional ones, thus improving productivity and allowing reduction of costs.

Figure 12:
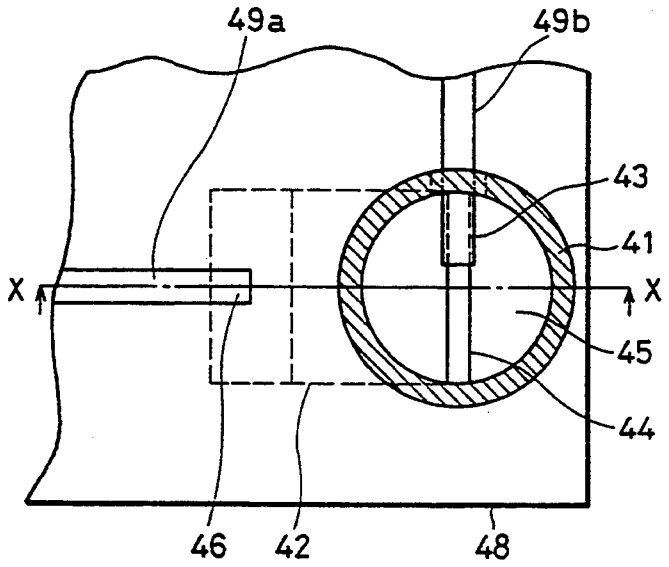
FIG. 12 is a top plan view showing a waveguide to microstrip converter in accordance with a seventh embodiment of the present invention.
Figure 13:
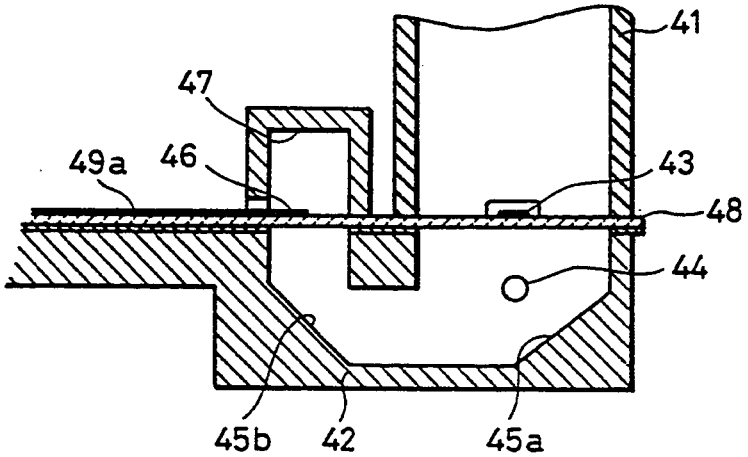
FIG. 13 is a sectional view showing the waveguide to microstrip converter shown in FIG. 12 taken along line X—X.

A seventh embodiment shown in FIGS. 12 and 13 is also an application of the fourth embodiment shown in FIG. 8.

Referring to FIGS. 12 and 13, the waveguide to microstrip converter of the present embodiment includes a circular waveguide 41, a rectangular waveguide 42 integrally connected with circular waveguide 41 and formed extending in the direction orthogonal to circular waveguide 41, a microstrip circuit substrate 48 attached and held between circular waveguide 41 and rectangular waveguide 42, microstrip lines 49*a* and 49*b* formed on microstrip circuit substrate 48, a first probe 43 formed of microstrip line 49*b* (see FIG. 12) protruding into the hollow part of circular waveguide 41, a second probe formed of microstrip line 49*a* further extending, a shorting circuit plate 47 (see FIG. 13) integrally provided with rectangular waveguide 42 so as to define a prescribed space in the upper part of second probe 46, reflection surfaces for matching 45*a* and 45*b* (see FIG. 13) provided at the opposing ends of the hollow part of the rectangular waveguide in the bottom wall 45, and a shorting circuit member 44 provided between first probe 43 and reflection surface for matching 45*a* and formed ¼ wavelength apart from and in the same direction as first rod 43.

As in the foregoing, in the seventh embodiment, by using rectangular waveguide 42 having two reflection surfaces for matching 45*a* and 45*b* at its corner (E corner or E bend) of the bottom wall 45 (FIG. 12), not only first probe 43 but also second probe 46 can be formed by strip lines. Consequently, further reduction of the number of parts necessary as well as simplification of the device can be achieved. This effectively increases the productivity.

Figure 14:
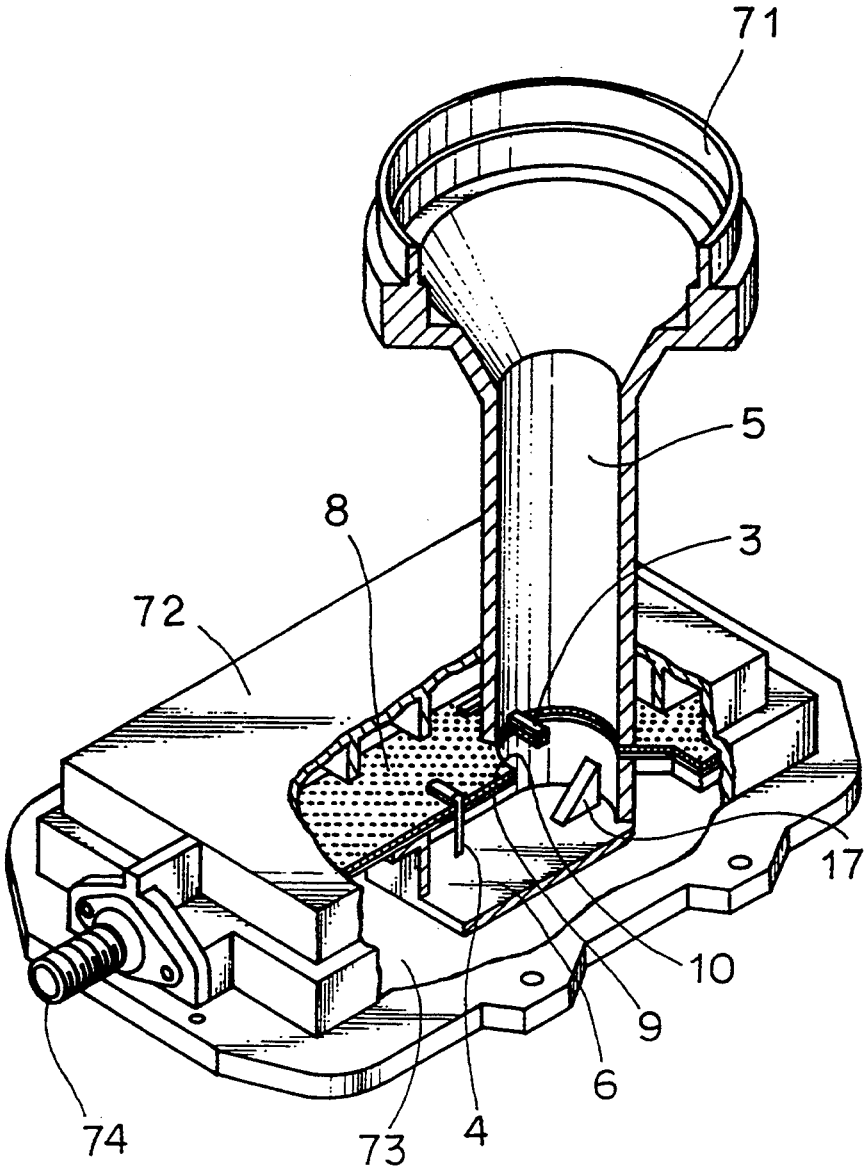
FIG. 14 is a perspective view showing an LNB including the waveguide to microstrip converter in accordance with the second embodiment shown in FIG. 6.
Figure 15:
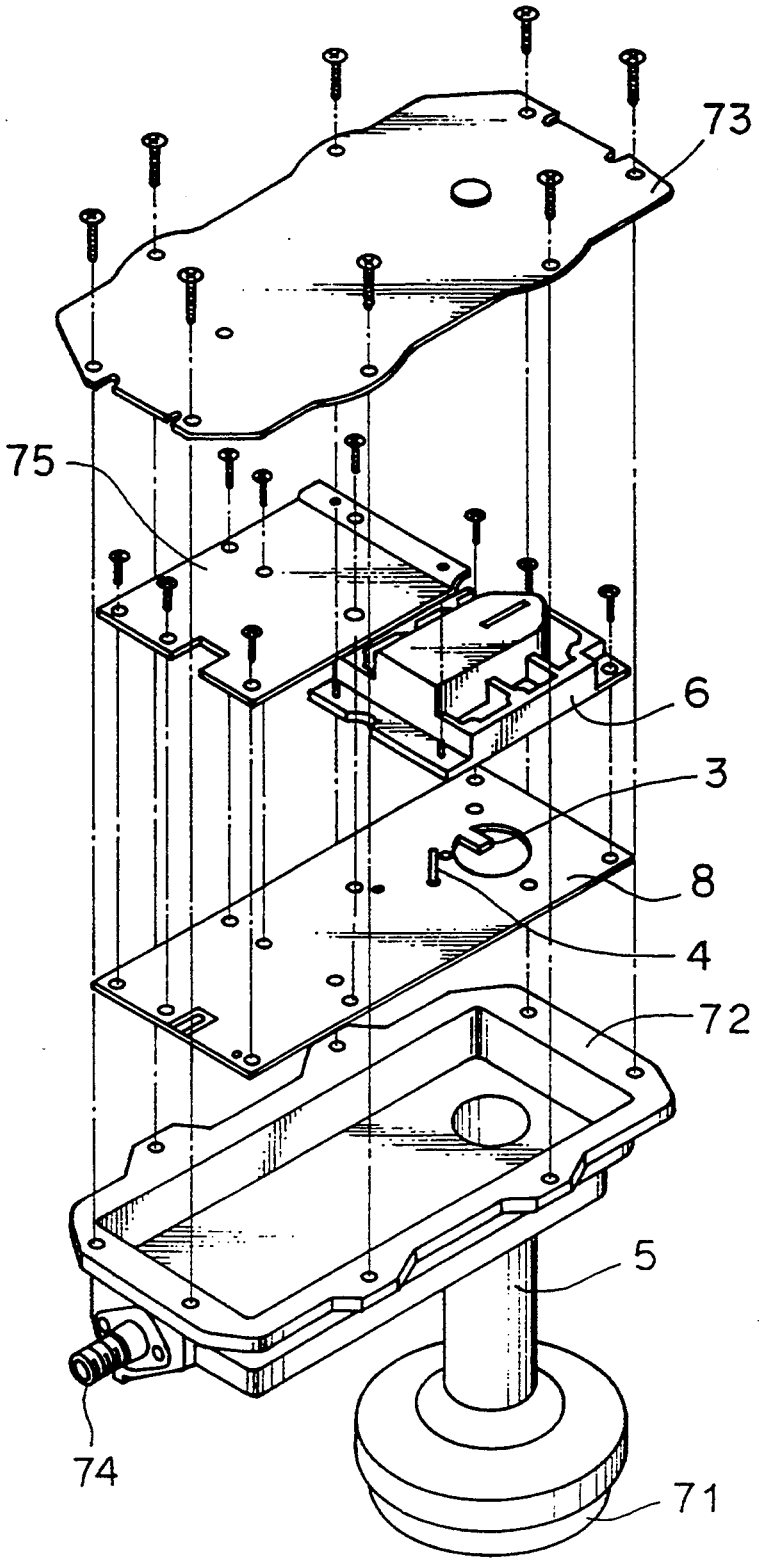
FIG. 15 is an exploded perspective view showing the LNB shown in FIG. 14.

FIG. 14 is a perspective view showing a converter for antenna for satellite broadcasting (Low Noise Blockdown or LNB Converter) including the waveguide to microstrip converter in accordance with the second embodiment shown in FIG. 6. FIG. 15 is a perspective view showing the converter for antenna for satellite broadcasting shown in FIG. 14. FIG. 15 is an exploded perspective view showing the converter for antenna for satellite broadcasting shown in FIG. 14. Referring to FIGS. 14 and 15, the converter for antenna for satellite broadcasting includes the waveguide to microstrip converter in accordance with the second embodiment shown in FIG. 6. The outer end portion of circular wave guide 5 constituting the waveguide to microstrip converter is provided with a feed horn (horn) 71 for guiding first and second linearly polarized waves reflected and converged by a reflection mirror (not shown) to circular waveguide 5. The waveguide to microstrip converter is covered with a chassis 72 and a rear cover 73. Chassis 72 and rear cover 73 are provided for anti environmental protection of microstrip circuit substrate 8, stabilization of circuit operation, and shielding against emission of unwanted signals. Microstrip circuit substrate 8 has a function of amplifying and converting the frequency of a signal received by first probe 3 and second probe 4. At a side portion of chassis 72, an F type coaxial connector 74 being a signal output terminal of LNB converter is provided. As shown in FIG. 15, a plate member 75 for fixing microstrip circuit substrate 8 and stabilizing circuit operation is attached between a rear cover 73 and microstrip circuit substrate 8.

As described above, in the LNB converter shown in FIGS. 14 and 15, by the provision of waveguide to the microstrip converter in accordance with the second embodiment shown in FIG. 6, the waveguide to coaxial adapter can be constructed with one microstrip circuit substrate 8. As a result, the number of parts necessary will be reduced, thereby reducing costs for the LNB apparatus as a whole. Constructing the top surface of rectangular waveguide 6 which also includes the triangular shaped impedance matching element 17 by ground plane surface 9 (see FIG. 14) forming the bottom surface of the board 10 (see FIG. 14) of microstrip circuit substrate 8 simplifies the shapes of parts and reduces parts materials. Thus, the productivity is improved, and costs may further be reduced. Furthermore, the waveguide to microstrip converter in accordance with the second embodiment shown in FIG. 6 can achieve both reduction in size and improvements in performance such as cross polar discrimination, the LNB converter incorporating this adaptor can provide the same effect. Furthermore, the LNB converter incorporating the waveguide to microstrip converter in accordance with each of the other embodiments can provide the same effect.

Figure 16:
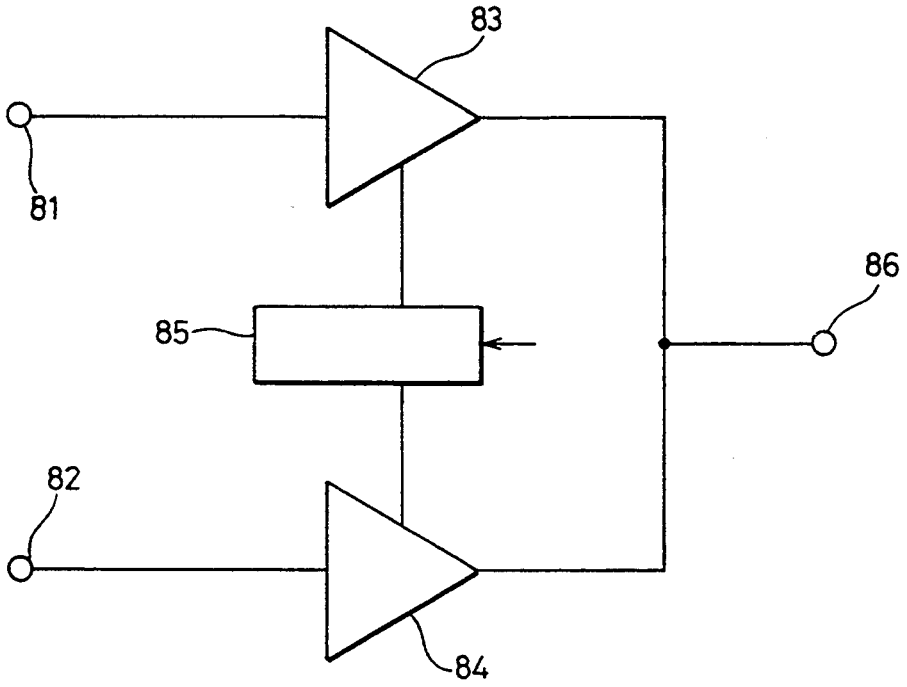
FIG. 16 is a block diagram showing a transmission line path switch circuit having a different matching circuit included in the LNB shown in FIG. 14.

FIG. 16 is a block diagram for use in illustration of a transmission line path switch circuit in the LNB converter shown in FIGS. 14 and 15. Referring to FIG. 16, the transmission line path switch circuit includes a first linearly polarized wave input portion (first probe) 81 for receiving a first linearly polarized wave, a first amplification circuit 83 connected to first linearly polarized wave input portion 81, a second linearly polarized wave input portion (second probe) 82 for inputting a second linearly polarized wave, a second amplification circuit 84 connected to second linearly polarized input portion 82, a switching bias control circuit 85 for first amplification circuit 83 and second amplification circuit 84, and a common output terminal 86. First amplification circuit 83 and second amplification circuit 84 have field effect transistors (FET) equivalent and equal in performance to each other as their amplification elements. In operation, when the first linearly polarized wave is received, first amplification circuit 83 is turned on, and second amplification circuit 84 is turned off. When the second linearly polarized wave is received, first amplification circuit 83 is turned off, and second amplification circuit 83 is turned on.

Figure 17:
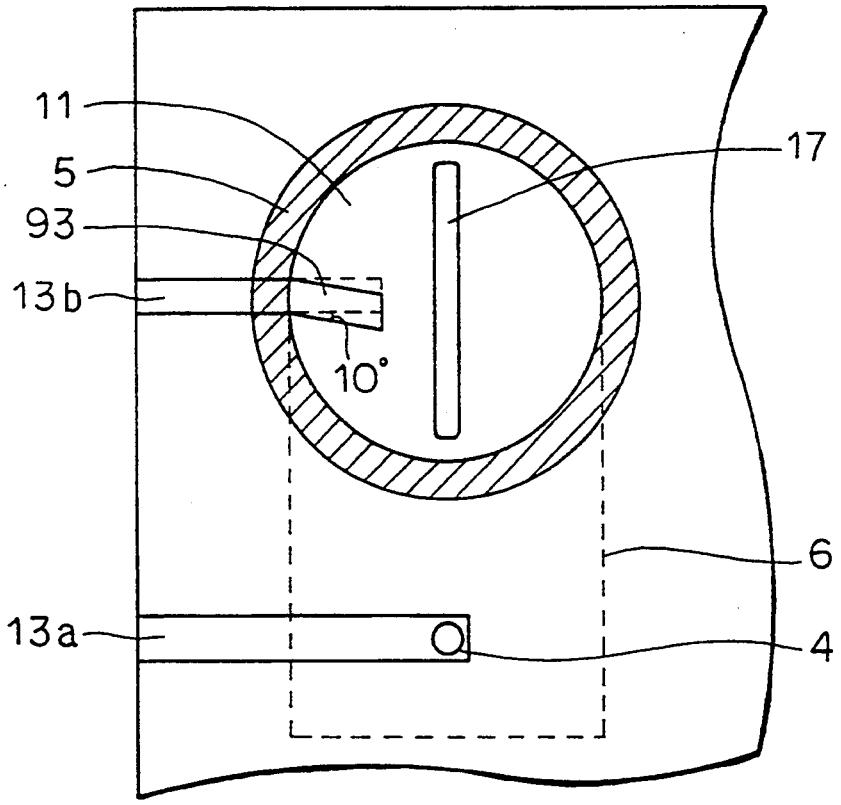
FIG. 17 is a plan view showing a waveguide to microstrip converter in accordance with an eighth embodiment which is an improved version of the waveguide to microstrip converter in accordance with the second embodiment shown in FIG. 6.
Figure 18:
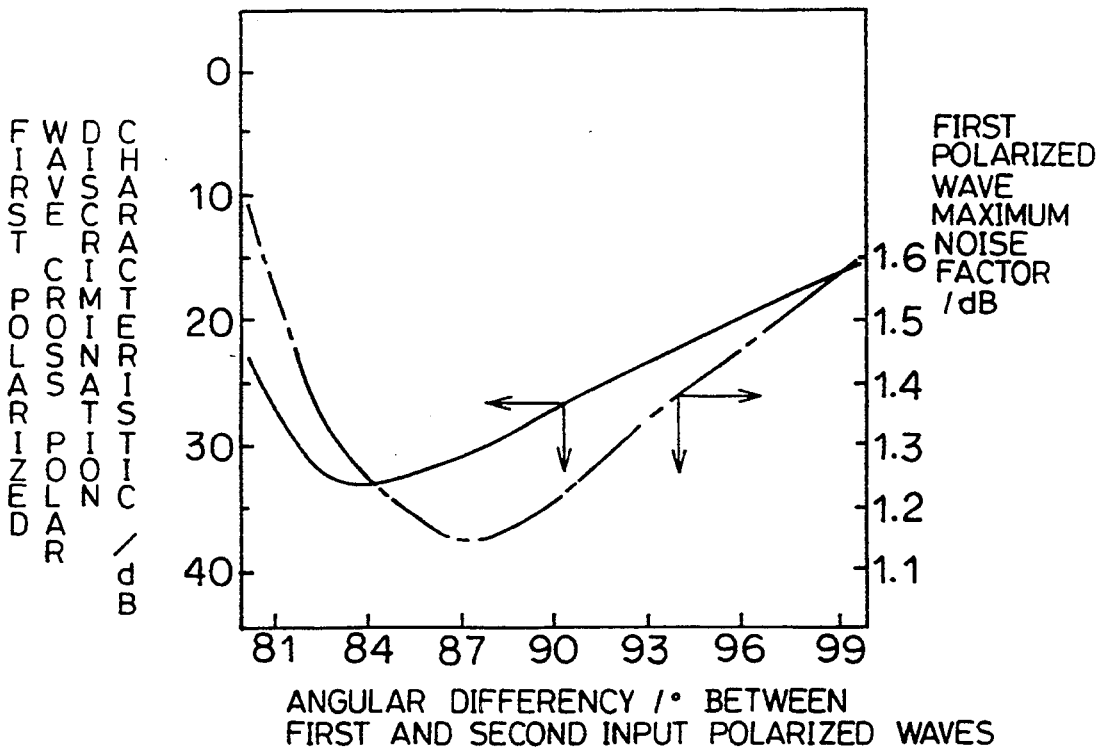
FIG. 18 is a representation showing the relation between cross polar discrimination, maximum noise factor, and the angular difference between first and second input polarized waves in accordance with the second embodiment shown in FIG. 6.
Figure 19:
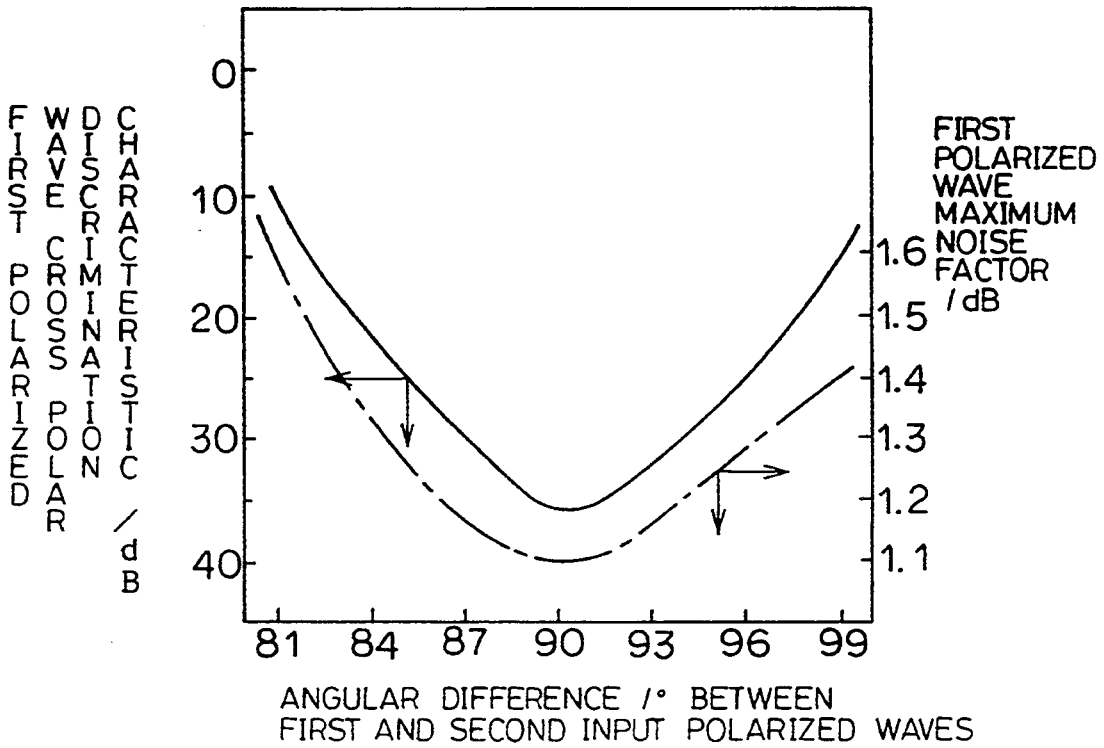
FIG. 19 is a representation showing the relation between the cross polar discrimination, maximum noise factor, and the angular difference between first and second input polarized waves of the wave guide to microstrip converter in accordance with the eighth embodiment shown in FIG. 17.

FIG. 17 is a plan view showing a waveguide to microstrip converter in accordance with an eighth embodiment which is an improved version of the waveguide to microstrip converter in accordance with the second embodiment shown in FIG. 6. Referring to FIG. 17, in the waveguide to microstrip converter in accordance with the eighth embodiment, unlike the waveguide to microstrip converter in accordance with the second embodiment shown in FIG. 6, a first probe 93 coupled to a first microstrip line 13*b* is provided with a tilt of about 10°. This is for the following reason. First probe 93 is logically preferred to be parallel to a polarization surface. However, according to the waveguide structure of the invention it includes a circular waveguide 5 joined to a rectangular waveguide 6 having a bottom wall 11. Matching reflector rib 17, etc. are provided in the waveguide, with second probe 4 coupled to a second microstrip line 13*a* being provided in rectangular waveguide 6. Therefore, the polarization surface is not always in an ideal condition. This is considered from an actual experimental result. FIG. 18 is a representation showing the relation between the cross polar discrimination and maximum noise factor ($NF_{MAX}$) of the waveguide to microstrip converter in accordance with the second embodiment shown in FIG. 6 and the angular difference between first and second input polarized waves. Referring to FIG. 18, the angular difference between first and second input polarized waves at the optimum maximum noise factor ($NF_{MAX}$) is different from the angular difference between first and second input polarized waves at the best cross polar discrimination. Furthermore, the angular difference between the first and second input polarized waves is smaller than 90°. Considering actual specification values, there will be no problem if NF=1.5 dBmax, and cross polar discrimination is 20 dBmin. However, considering an angular error generated in attaching an antenna or the like, the maximum noise factor ($NF_{MAX}$) and the cross polar discrimination is 20 dBmin. However, considering an angular error in attaching an antenna or the like, the maximum noise factor ($NF_{MAX}$) and the cross polar discrimination are both preferred to be at the angular difference between first and second input polarized waves of 90°. From this view point, in the eighth embodiment shown in FIG. 17, first probe 93 is turned clockwise about 10°. This provides the following effect. FIG. 19 is a representation showing the relation between the maximum noise factor, cross polar discrimination and the angular difference between first and second input polarized waves of the wave guide to microstrip converter in accordance with the eighth embodiment shown in FIG. 17. Referring to FIG. 19, the optimum points of the maximum noise factor and the cross polar discrimination are both at a position where the angular difference between the first and second input polarized waves is 90°. The angular difference is preferably 90°, because down link signals from a satellites are always horizontal and vertical, in other words the angular difference is always 90°, and therefore, a waveguide to microstrip converter incorporated in an LNB converter is also preferred to present its optimum performance when the input polarized wave angular difference is 90°. In operation, a first linearly polarized wave is first received by first probe 93. Then, the first linearly polarized wave reflected upon the lower short circuit terminal A (surface 11) is received by first probe 93. The distance between first probe 93 and short circuit terminal A (surface 11) is logically $\lambda/4$.

However, since the second linearly polarized wave is guided to rectangular waveguide 6 and further to an amplifier through second probe 4. Impedance in the waveguide attains less than an ideal state (not in one to one correspondence between waveguide and probe). As a result, a polarization mode is likely to turn (clockwise) toward rectangular waveguide 6. Thus, the reflected wave of the first linearly polarized wave is turned clockwise. In order to suppress such a phenomenon, first probe 93 is skewed and provided with a 10° offset. Thus, mismatching between a received wave and a reflected wave can effectively be solved. Increase in reactance component by tilting first probe 93 is matched with an amplification element (FET) by increasing the conductance of a matching circuit on the input side included in first amplification circuit 83 shown in FIG.

16, and the degradation of the maximum noise factor ($NF_{MAX}$) can be improved. As described above, according to the embodiment, first probe 93 is structured to have about a 10° offset so that $NF_{MAX}$ and cross polar discrimination become best when the angular difference between polarized waves received at first probe 93 and second probe 4 is 90°. At the same time, the conductance of the input matching circuit included in the first amplification circuit 83 of first probe 93 is to be increased.

As in the foregoing, according to the waveguide to microstrip converter of the invention, an orthogonal transducer form is employed in which a first waveguide and a second waveguide coupled substantially orthogonally thereto are provided, and first and second probes are provided for the first and second wave guides, respectively. Matching means for guiding the second linearly polarized wave into the second waveguide is provided, and as a result degradation in performance such as cross polar discrimination can be prevented without increasing the size of the device as practiced according to a conventional technique, so that good cross polar discrimination and input VSWR characteristic can be provided while achieving reduction in size. Forming the output end of the first probe and the output end of the second probe in one plane permits arrangement by a single microstrip circuit substrate, thereby improving productivity as well as reducing cost for the device.

The converter for antenna for satellite broadcasting including the waveguide to microstrip converter according to the invention includes a waveguide to microstrip converter which takes a form of orthogonal transducer in which a first waveguide and a second waveguide substantially orthogonal thereto are provided, first and second probes are provided for first and second waveguides, respectively, and matching means for guiding the second linearly polarized wave to the second waveguide is provided, whereby good cross polar discrimination and input VSWR characteristic can be provided while achieving reduction in size for the device as a whole.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. Waveguide to microstrip conversion means for receiving first and second linearly polarized waves orthogonal to each other, comprising:

a first conversion portion including a first waveguide receiving both said polarized waves, a first probe coupled to said first waveguide and having an orientation for detecting said first linearly polarized wave, and rod type shorting means located a quarter wavelength away and substantially parallel to the orientation of said first probe;

a second conversion portion including a second waveguide connected with and substantially orthogonally to said first waveguide for receiving only said second polarized wave from said first waveguide, a second probe coupled to said second waveguide and having an orientation for detecting said second linearly polarized wave, and a wall type shorting means located a quarter wavelength away and approximately parallel to the orientation of said second probe; and impedance matching means comprising an inclined flat waveguide wall member located at a juncture of and facing said first and second waveguides for directing only said second polarized wave into said second waveguide.

2. Waveguide to microstrip conversion means as recited in claim 1 wherein said first waveguide comprises a circular waveguide and said second waveguide comprises a rectangular waveguide.

3. A converter for an antenna for satellite broadcasting including waveguide to microstrip conversion means for receiving first and second linearly polarized waves orthogonal to each other, said converter comprising:

a first waveguide receiving both said first and second polarized waves;

a second waveguide coupled substantially orthogonally to said first waveguide receiving only said second polarized waves from said first waveguide;

a first probe coupled to said first waveguide for detecting said first linearly polarized wave;

a second probe coupled to said second waveguide for detecting said second linearly polarized wave;

first short circuit means located a quarter wavelength away from said first probe;

second short circuit means located a quarter wavelength away from said second probe;

impedance matching means located between said first and second waveguides for guiding said second linearly polarized wave to said second waveguide;

a single substrate for supporting a pair of planar microstrip lines; and a first microstrip line and a second microstrip line respectively of said pair of planar microstrip lines being respectively coupled to said first and second probes and being disposed on said single substrate; and a horn coupled to an outer end portion of said first waveguide for guiding said first and second linearly polarized waves to said first waveguide.

4. A converter for an antenna for satellite broadcasting as recited in claim 3, and further comprising transmission line switch means and first and second amplification circuit means for said first and second linearly polarized waves coupled to said switch means, wherein said first amplification circuit means includes said first probe for receiving said first linearly polarized wave, said second amplification circuit includes said second probe for receiving said second linearly polarized wave, and wherein said first probe is skewed at a predetermined angle relative to said first microstrip line so that an angular difference between received polarized waves at a minimum value of noise factor and an angular difference between the received first and second polarized waves at a maximum value of cross polar discrimination are both substantially 90° when said first and second linearly polarized waves are received.

5. Waveguide to microstrip conversion means as recited in claim 4 wherein said first probe is skewed relative to said first microstrip line at an angle of approximately 10°.

6. Waveguide to microstrip conversion means for receiving first and second linearly polarized waves orthogonal to each other, comprising:

a first conversion portion including a first waveguide, said first waveguide receiving both said polarized waves and having a first probe located at a prescribed position on said first waveguide and protruding at an orientation therein for detecting said first linearly polarized wave, and first short circuit means located a quarter waveguide away and substantially parallel to the orientation of said first probe;

a second conversion portion including a second waveguide connected with and being substantially orthogonal to said first waveguide, a second probe located at a prescribed position on said second waveguide and protruding at an orientation therein for detecting said second linearly polarized wave, and second short circuit means located a quarter wavelength away and approximately parallel to the orientation of said second probe;

impedance matching means provided at a juncture of said first and second waveguides for directing said second polarized wave in said second waveguide where said second polarized wave is detected by said second probe;

a single substrate secured to at least one of said first and second waveguides; and a first microstrip line and a second microstrip line respectively coupled to said first and second probes, disposed on said substrate.

7. Waveguide to microstrip conversion means as recited in claim 6 wherein said first probe is angularly offset relative to said first microstrip line in a plane of said single substrate.

8. Waveguide to microstrip conversion means as recited in claim 6, wherein said impedance matching means comprises a waveguide member having a shape of a triangularly shaped narrow rib.

9. Waveguide to microstrip conversion means as recited in claim 6, wherein said impedance matching means comprises a waveguide member located a predetermined distance away from an internal wall surface of said first waveguide.

10. Waveguide to microstrip conversion means as recited in claim 6, wherein said impedance matching means comprises a waveguide member located at a terminal end of said second waveguide.

11. Waveguide to microstrip conversion means as recited in claim 6, wherein said first short circuit means comprises a rod shaped short circuit element.

12. Waveguide to microstrip conversion means as recited in claim 6, wherein one side of said second waveguide is defined by a ground plane surface on a bottom surface of said substrate and wherein said first and second microstrip lines are disposed on a top surface of said substrate.

13. Waveguide to microstrip conversion means as recited in claim 6, wherein said first and second probes are disposed on said single substrate.

14. Waveguide to microstrip conversion means as recited in claim 13, wherein said first and second probes are comprised of microstrip lines respectively coupled to said first and second microstrip lines.

15. Waveguide to microstrip conversion means as recited in claim 6 wherein said first waveguide comprises a circular waveguide and said second waveguide comprises a rectangular waveguide.

16. Waveguide to microstrip conversion means as recited in claim 6 wherein said first waveguide comprises a rectangular waveguide and said second waveguide comprises a circular waveguide.

17. Waveguide to microstrip conversion means as recited in claim 6 wherein both said first and second waveguides comprise rectangular waveguides.

18. Waveguide to microstrip conversion means as recited in claim 2 wherein said first and second microstrip lines respectively comprise output terminals of said first and second probes.

19. Waveguide to microstrip conversion means as recited in claim 6 wherein said impedance matching means comprises a wedge shaped waveguide member located at a juncture of said first and second waveguides and having an inclined surface facing both said waveguides.

* * * * *